US005686159A

United States Patent [19]

Langan

[11] Patent Number: 5,686,159

[45] Date of Patent: Nov. 11, 1997

[54] IMAGABLE PIGGYBACK LABEL

[75] Inventor: Joseph W. Langan, Cheektowaga, N.Y.

[73] Assignee: Moore Business Forms, Inc., Grand Island, N.Y.

[21] Appl. No.: 329,260

[22] Filed: Oct. 26, 1994

[51] Int. Cl.[6] ..... G09F 3/02

[52] U.S. Cl. ..... 428/40.1; 283/81; 428/43; 428/192; 428/195; 428/198; 428/447; 428/913; 428/914; 503/200; 503/204; 503/206; 503/226

[58] Field of Search ..... 428/40, 43, 192, 428/447, 913, 914, 195, 198; 503/200, 226, 204, 206; 427/150–152; 283/81

[56] References Cited

U.S. PATENT DOCUMENTS

| | | | |
|---|---|---|---|
| 3,383,121 | 5/1968 | Singer | 282/28 |
| 4,277,089 | 7/1981 | Lockhart | 282/27 R |
| 4,551,738 | 11/1985 | Maruta et al. | 346/200 |
| 4,577,204 | 3/1986 | Shibata et al. | 346/200 |
| 4,633,276 | 12/1986 | Shibata et al. | 346/200 |
| 4,663,641 | 5/1987 | Iiyama et al. | 346/204 |
| 4,707,211 | 11/1987 | Shibata | 156/354 |
| 4,720,479 | 1/1988 | Craig et al. | 503/200 |
| 4,784,714 | 11/1988 | Shibata | 156/354 |
| 4,833,122 | 5/1989 | Doll et al. | 503/226 |
| 4,851,383 | 7/1989 | Fickenscher et al. | 503/200 |
| 4,898,848 | 2/1990 | Kang | 503/214 |
| 4,927,801 | 5/1990 | Mahmud | 503/200 |
| 5,061,677 | 10/1991 | Yoshida et al. | 503/226 |
| 5,075,369 | 12/1991 | Mahmud | 524/475 |
| 5,141,914 | 8/1992 | Kang | 503/226 |
| 5,209,698 | 5/1993 | Dolan | 281/2 |
| 5,219,821 | 6/1993 | Arbee et al. | 503/226 |
| 5,278,128 | 1/1994 | Hotta et al. | 503/207 |
| 5,283,221 | 2/1994 | Inobe | 503/204 |
| 5,299,979 | 4/1994 | Ballard | 462/18 |
| 5,352,155 | 10/1994 | Fahey | 462/25 |

FOREIGN PATENT DOCUMENTS

| | | |
|---|---|---|
| 600622 | 6/1994 | European Pat. Off. . |
| WO93/18928 | 9/1993 | WIPO . |

*Primary Examiner*—Nasser Ahmad

*Attorney, Agent, or Firm*—Nixon & Vanderhye P.C.

[57] ABSTRACT

A piggyback label construction includes a first label having a stock ply with a bottom face having pressure sensitive adhesive, and an imagable top face. A second label comprises a stock ply having a bottom face with pressure sensitive adhesive, a top face with a continuous image-producing coating, and a continuous adhesive release coating over the image-producing coating. The image-producing coating preferably is a thermosensitive coating having a first heat activation temperature of about 140°–250° F. (preferably about 145°–155° F). The first label stock ply has a weight of about 30 lbs. per 1000 sheet 11"×17" ream, or less (preferably about 18–30 lbs.). The first label stock imagable top face preferably is a second thermosensitive coating having a higher heat activation temperature than the first heat activation temperature. The image-producing coating may comprise a self-contained coating. The first label may be offset from the second label to provide an exposed portion of the second label image-producing portion which is separated from the rest of the construction by a perforation line, and having pre-printed non-variable indicia.

17 Claims, 2 Drawing Sheets

Fig. 4
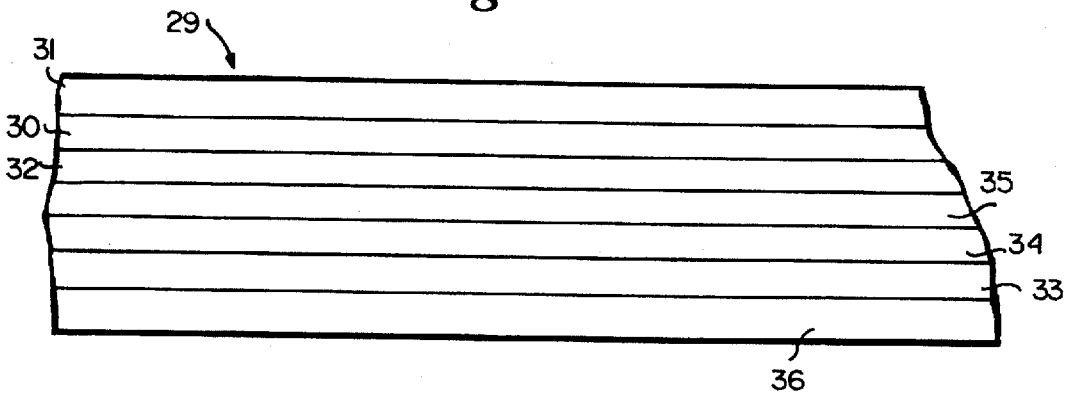
Fig. 5
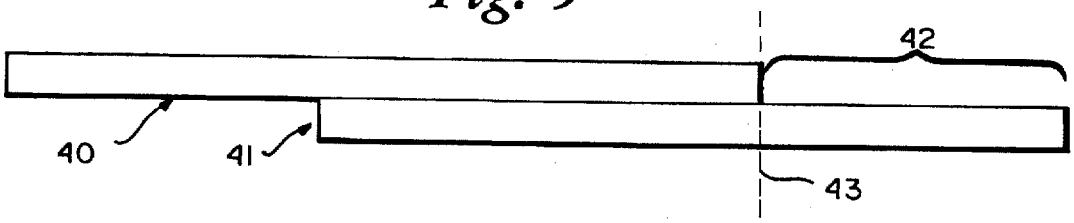
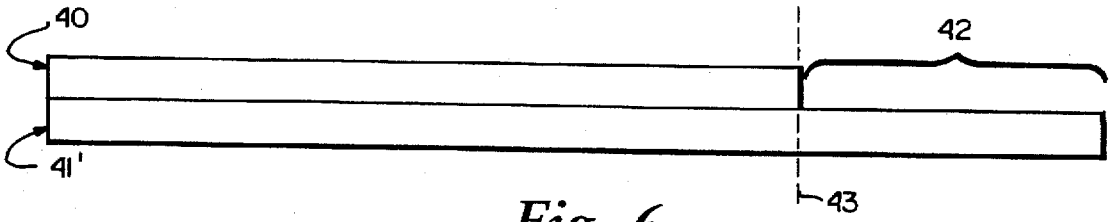
Fig. 6

IMAGABLE PIGGYBACK LABEL

BACKGROUND AND SUMMARY OF THE INVENTION

Piggyback labels are utilized in a wide variety of different procedures in the production of modern business forms. It is advantageous in piggyback labels to produce both labels with a construction such that they can be imaged by using the same or different printers while assembled together. U.S. Pat. No. 5,283,221 shows a number of ways in which this can be accomplished, however the techniques set forth therein are limited to very special constructions. For example in the U.S. Pat. No. 5,283,221 it is possible to print an underlying label only at a central location, not over the whole surface thereof.

According to the present invention a piggyback label construction is provided which has greater versatility than prior art constructions and allows printing of a top label with a first printer and a lower label with the same or another printer. Also according to the present invention both labels in a piggyback label construction may be imaged using thermal transfer or thermal direct printing technologies, and over substantially the entire surfaces thereof. These desirable results are accomplished according to the present invention by utilizing particular coatings having differential thermosensitivity, or providing other types of coating on the top or bottom labels of the piggyback construction.

According to one aspect of the present invention a piggyback label construction is provided comprising the following elements: A first label comprising a stock ply having a bottom face with pressure sensitive adhesive, and an imagable top face. And, a second label comprising a stock ply having a bottom face with pressure sensitive adhesive, a top face with a continuous image-producing coating, and a continuous adhesive release coating over said image-producing coating.

The image-producing coating preferably comprises a thermosensitive coating having a first heat activation temperature of about 140°–250° F.—preferably about 145°–155° F. The first label stock ply has a weight of about 30 lbs. per 1000 sheet 11"×17" ream, or less—preferably comprising electronic data processing (EDP) paper which absorbs applied ink quickly and does not smudge, having a weight of about 18–30 lbs. By thus providing the outer label with a very low caliper, heat can easily transfer through it to the underlying label. If the outer label is too thick then it acts as an insulator and prevents proper pass-through of the heat or proper imaging of the underlying label. The degree of activation of the underlying label construction will depend upon upper layer construction, but preferably is as described above.

The first label stock imagable top face may comprise a second thermosensitive coating having a higher heat activation temperature than the first heat activation temperature (that is differential sensitivity). Alternatively the image-producing coating may comprise a self-contained coating. Pre-printed non-variable indicia may be provided on the second label.

The first label may be offset from the second label, providing an exposed portion of the second label image-producing portion. The exposed portion may be separated from the rest of the construction by a line of weakness (such as a perforation line). Pre-printed non-variable indicia may be provided on the exposed portion.

According to another aspect of the present invention a so piggyback label construction is provided comprising the following elements: A first label comprising a stock ply having a bottom face with pressure sensitive adhesive, and an imagable top face. And, a second label comprising a stock ply having a bottom face with pressure sensitive adhesive, a top face with a thermosensitive coating having a first heat activation temperature of about 145°–155° F, and an adhesive release coating over the thermosensitive coating. The details of the label constructions are preferably as described above.

According to yet another aspect of the present invention another piggyback label construction is provided comprising the following elements: A first label comprising a stock ply having a bottom face with pressure sensitive adhesive and a thermosensitive coating on a top face. And, a second label comprising a stock ply having a bottom face with pressure sensitive adhesive, a top face with a self-contained coating, and an adhesive release coating over the self-contained coating. The first label may be offset from the second label, providing an exposed portion of the second label self-contained portion.

The piggyback label construction according to the invention may be printed in a first non-impact printer, which prints the top label while the underlying label is not imaged, and then it may pass through a thermal printer where the second layer is imaged due to its high thermal sensitivity and heat transfer through the top label due to the low caliper of the top label. The indicia printed on the top label remains intact as the first layer is not sensitive to heat. The release layer provided on the underlying label does not present a problem with imaging. The printing can be done in black, blue, or other colored ink. Alternatively, printing may be done with two separate thermal printers, or in the same thermal printer (having different heads) simultaneously.

It is the primary object of the present invention to provide the effective printing of two (or more) piggyback labels without having to separate the labels or pre-print them before assembly of the piggyback label construction. This and other objects of the invention will become clear from an inspection of the detailed description of the invention and from the appended claims.

BRIEF DESCRIPTION OF THE DRAWINGS

FIG. 4 is a view like that of FIGS. 1 and 2 of a third embodiment; and FIGS. 5 and 6 are side schematic views of two further embodiments of piggyback label constructions according to the invention, illustrating the entire label assemblies rather than the individual layers thereof as in FIGS. 1, 2, and 4.

DETAILED DESCRIPTION OF THE DRAWINGS

Figure 1:
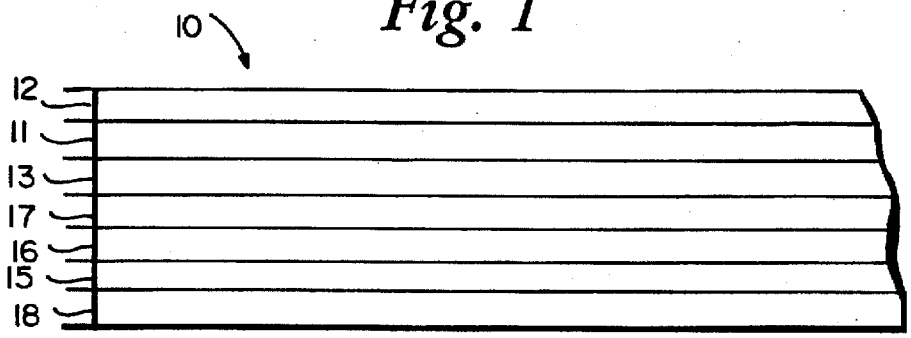
FIG. 1 is a side schematic view, with the layers greatly enlarged for clarity of illustration, of an exemplary piggyback label construction according to the present invention.

A first embodiment of a piggyback label assembly according to the present invention is shown generally at 10 in FIG. 1. A first label, which is the top label, includes a stock ply 11 with an imagable top face, e.g. provided by a continuing thermosensitive coating 12, and the bottom face provided with pressure sensitive adhesive 13 substantially over the entire surface thereof. The stock ply 11 may comprise a wide variety of papers, but preferably has very low caliper (that is minimum thickness) so as to allow heat to transfer therethrough to an underlying label. For example the label stock 11 may comprise an electronic data processing (EDP) grade material which typically absorbs ink quickly and does not smudge readily and can be used soon after printing. It typically has a weight of about 30 lbs. or less (i.e. 30 lbs. per 1000 sheet 11"×17" ream). Preferably it has a weight of about 18–30 lbs.

The thermosensitive coating 12 may be of the type that provides a thermal image by the use of a NIP thermal transfer printer, that is the thermal paper having a hot melt ink which transfers an image to the receptor sheet. The thermal paper may either have a waxy coating or use heat rupturable microspheres to develop the image. Sources of such paper (the stock 11 with the coating 12) include Appleton Paper of Appleton, Wis., Ricoh of California, and Labelon of New York. Image application may also be accomplished by heat softened coating on a ribbon.

The second label of the piggyback construction 10 includes a stock sheet 15, typically of paper, which may have almost any conventional weight, with a thermosensitive coating 16 and an adhesive release coating 17 over the thermosensitive coating 16. A pressure sensitive adhesive 18 is provided on the bottom face of the stock layer 15.

The thermosensitive coating 18 has a low to very low heat activation point. The degree of activation is affected by the upper label 11–13 construction and the denser the upper label construction 11–13 the lower the activation point required for the layer 16. The second label construction 15–18 is commercially available from Appleton Paper, Ricoh, Nashua, and others. The thermosensitive coating 16 may have a first heat activation temperature of about 140°–250° F., preferably about 145°–155° F. This first heat activation temperature is typically lower than the heat activation temperature of the layer 12.

The release layer 17 is preferably of a layer of silicone, but other fatty acid derivatives may be used, and it easily releases from adhesive 13. The pressure sensitive adhesive layers 13, 18 can be permanent, removable, repositional, acrylic, rubber, water based, hot melt, or solvent based. The coatings 16, 17 are preferably continuous over substantially the entire face of the stock 15 rather than being merely applied at marginal portions thereof. The coating 17 allows the adhesive 13 to readily release so that the two labels 11–13 and 15–18 may be detached from each other. The label construction 10 may be printed utilizing separate thermal printer units with different temperature capabilities.

Figure 2:
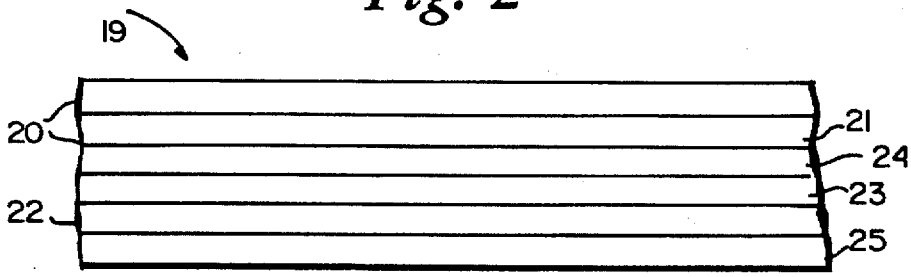
FIG. 2 is a view like that of FIG. 1 for a second embodiment of a piggyback label construction.

In the embodiment of FIG. 2 a piggyback label construction 19 is provided which includes a first label provided by the layers 20, 21. The layer 20 is a stock ply, e.g. uncoated EDP 18–30 lb. paper with the top face thereof imagable by an ink jet or impact printer, or the like. The layer 21 is a pressure sensitive adhesive layer like the layer 13.

In the FIG. 2 embodiment the second label construction comprises the layers 22–25, the layer 22 being a stock ply, the layer 23 an image-producing coating (such as a thermal coat of low heat activation temperature), a release coat 23 like the release coat 17, and a pressure sensitive adhesive coat 25 like the coat 18.

Figure 3:
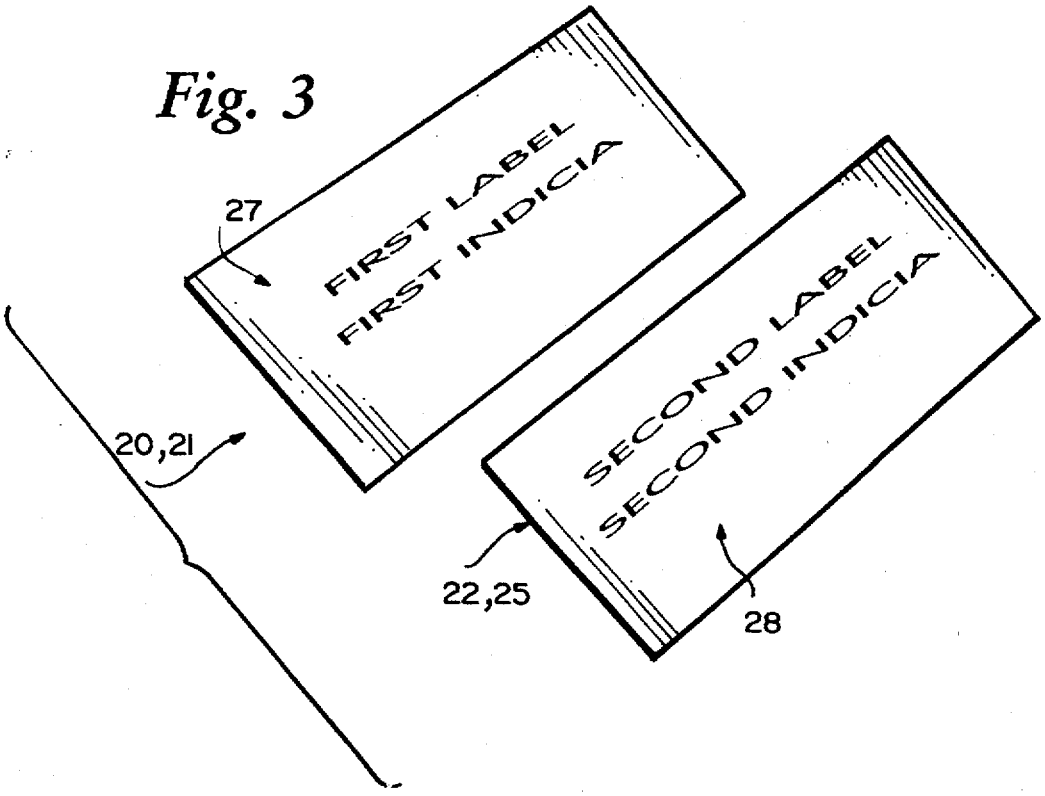
FIG. 3 is a top perspective view of the piggyback labels of the construction of FIG. 2 separated from each other.

FIG. 3 shows the labels of the piggyback construction 19 after they have been detached from each other, and indicia has been applied thereto, indicia 27 having been applied to the top label 20, 21 and indicia 28 applied to the top face of the underlying label 22–25.

In all of the above embodiments pre-printed, non-variable indicia (such as coupon, weight indicia, gaming indicia, etc.) may be provided on the stock layers, with only the variable indicia provided by the thermal, ink jet, impact, or like printers.

FIG. 4 illustrates another embodiment of a piggyback label assembly 29. The first label comprises a very low caliper (e.g. 30 lb. or less) stock ply 30 with a thermosensitive coating 31 and pressure sensitive adhesive 32, just like the label 11–13 of the FIG. 1 embodiment. The underlying label comprises the stock ply 33 with a self-contained imaging layer 34 covered by the release coating 35, and the pressure sensitive adhesive layer 36 on the bottom of ply 33. The label 33–36 is just like the label 15–18 except that instead of the thermosensitive layer 16 the self-contained layer 34 is provided. The self-contained layer 34 may comprise any suitable conventional image-producing self-contained coating which when impacted releases dye from microspheres to form an image on the ply 33 top surface. Thus the embodiment of FIG. 4 may be passed through a thermal printer for acting on the layer 31 to image the ply 30, and at a different time through an impact printer which has no affect on the ply 30 but forms a self-contained image on the layer 33.

FIG. 5 shows an embodiment having two piggyback labels 40, 41 in which the labels are offset. The label 40 may comprise any of the labels 11 to 13, 20–21, or 30–32, while the label 41 may comprise any of the labels 15–18, 22–25, or 33–36. Thus an exposed portion 42 of the second label 41 image-producing portion is provided and indicia applied thereto obviously will not be applied to the label 40. Also in this particular embodiment the exposed portion 42 need not be coated with the release layer (e.g. 17), although it may be. A line of weakness 43 may be provided in the label 41, such as a perforation line, allowing the exposed portion 42 to be readily removed from the label 41, e.g. as a receipt. Pre-printed non-variable indicia is typically provided on exposed portion 42 (e.g. facilitating its use as a receipt).

FIG. 6 illustrates another embodiment like that of FIG. 5 only the second, underlying label 41'is larger than the label 40, so that the left side (as viewed in FIG. 6) edges match up. Otherwise the construction of the assembly of FIG. 6 is like that of FIG. 5.

A conventional carrier is typically utilized to transport the piggyback label assemblies through printers.

It will thus be seen that according to the present invention a versatile and effective piggyback label construction has been provided having a number of advantages. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A piggyback label construction comprising:

a first label comprising a stock ply having a bottom face with pressure sensitive adhesive, and an imagable top face; and a second label comprising a stock ply having a bottom face with pressure sensitive adhesive, a top face with a continuous image-producing coating substantially completely covering said top face, and a continuous adhesive release coating and substantially coextensive with said image-producing coating; said pressure sensitive adhesive of said first label in contact with said adhesive release coating; and wherein said image-producing coating comprises a thermosensitive coating having a first heat activation temperature of abut 140° F.–250° F. and wherein said first label stock ply has a weight of about 30 lbs. per 1000 sheet 11"×17" ream, or less.

2. A piggyback label construction as recited in claim 1 wherein said thermosensitive coating has a heat activation temperature of about 145°–155° F.

3. A piggyback label construction as recited in claim 2 wherein said first label stock ply comprises electronic data processing paper which absorbs applied ink quickly and does not smudge, having a weight of about 18–30 lbs.

4. A piggyback label construction as recited in claim 1 wherein said first label stock imagable top face comprises a second thermosensitive coating having a higher heat activation temperature than said first heat activation temperature.

5. A piggyback label construction as recited in claim 1 wherein said first label stock ply comprises electronic data processing paper which absorbs applied ink quickly and does not smudge, having a weight of about 18–30 lbs.

6. A piggyback label construction comprising:

a first label comprising a stock ply having a bottom face with pressure sensitive adhesive, and an imagable top face; and a second lab comprising a stock ply having a bottom face with pressure sensitive adhesive, a top face with a continuous image-producing coating substantially completely covering said top face, and a continuous adhesive release coating over and substantially coextensive with said image-producing coating; said pressure sensitive adhesive of said first label in contact with said adhesive release coating; and wherein said first label is offset from said second label, providing an exposed portion of second label image-producing portion.

7. A piggyback label construction as recited in claim 6 wherein said exposed portion is separated from the rest of said construction by a line of weakness.

8. A piggyback label construction as recited in claim 7 further comprising pre-printed non-variable indicia on said exposed portion.

9. A piggyback label construction comprising:

a first label comprising a stock ply sheet having a bottom face with pressure sensitive adhesive, and an imagable top face; and a second label comprising a stock ply having a bottom face with pressure sensitive adhesive, a top face with a thermosensitive coating having a first heat activation temperature of about 145°–155° F., and an adhesive release coating over said thermosensitive coating; said pressure sensitive adhesive of said first label in contact with said adhesive release coating.

10. A piggyback label construction as recited in claim 9 wherein said first label stock has a weight of about 30 lbs. per 1000 sheet 11"×17" ream, or less.

11. A piggyback label construction as recited in claim 10 wherein said first label stock ply comprises electronic data processing paper which absorbs applied ink quickly and does not smudge, having a weight of about 18–30 lbs.

12. A piggyback label construction as recited in claim 10 wherein said first label stock imagable top face comprises a second thermosensitive coating having a higher heat activation temperature than said first heat activation temperature.

13. A piggyback label construction as recited in claim 10 further comprises pre-printed non-variable indicia on said second label.

14. A piggyback label construction as recited in claim 10 wherein said first label is offset from said second label, providing an exposed portion of second label image-producing portion.

15. A piggyback label construction comprising:

a first label comprising a stock ply sheet having a bottom face with pressure sensitive adhesive and a thermosensitive coating on a top face; and a second label comprising a stock ply having a bottom face with pressure sensitive adhesive, a top face with a self-contained coating, and an adhesive release coating over said self-contained coating; said pressure sensitive adhesive of said first label in contact with said adhesive release coating.

16. A piggyback label construction as recited in claim 15 wherein said first label is offset from said second label, providing an exposed portion of second label self-contained portion.

17. A piggyback label construction as recited in claim 1 wherein said stock ply of said first label has a lower caliper than the stock ply of said second label.

* * * * *